US011355881B2

(12) United States Patent
Wang et al.

(10) Patent No.: US 11,355,881 B2
(45) Date of Patent: Jun. 7, 2022

(54) ELECTRICAL CONNECTOR HOUSING, ELECTRICAL CONNECTOR AND ELECTRICAL CONNECTOR ASSEMBLY

(71) Applicant: Tyco Electronics (Shanghai) Co. Ltd., Shanghai (CN)

(72) Inventors: Yunhe Wang, Shanghai (CN); Zhigang Song, Shanghai (CN); Jiahui Chen, Shanghai (CN); Chuang Peng Zhou, Shanghai (CN); Songhua Liu, Dongguan (CN); Qianjin Li, Shanghai (CN)

(73) Assignee: Tyco Electronics (Shanghai) Co. Ltd., Shanghai (CN)

( * ) Notice: Subject to any disclaimer, the term of this patent is extended or adjusted under 35 U.S.C. 154(b) by 43 days.

(21) Appl. No.: 16/720,263

(22) Filed: Dec. 19, 2019

(65) Prior Publication Data

US 2020/0203873 A1 Jun. 25, 2020

(30) Foreign Application Priority Data

Dec. 21, 2018 (CN) ..... 201811578115.3

(51) Int. Cl.
*H01R 13/24* (2006.01)
*H01R 13/422* (2006.01)

(52) U.S. Cl.
CPC ..... *H01R 13/2421* (2013.01); *H01R 13/4226* (2013.01)

(58) Field of Classification Search
CPC ..... H01R 13/2421; H01R 13/4226; H01R 13/187; H01R 13/2407; H01R 13/24; H01R 13/2457; H01R 13/2428; H01R 11/18; H01R 13/111
See application file for complete search history.

(56) References Cited

U.S. PATENT DOCUMENTS 5,681,187 A * 10/1997 Fukushima ..... H01R 13/187 439/700
6,861,862 B1 * 3/2005 Tate ..... G01R 1/0466 324/756.02
7,682,206 B2 * 3/2010 Kainz ..... H01R 13/2421 439/824
7,857,671 B2 * 12/2010 Carboni ..... H01R 13/2421 439/824

(Continued)

FOREIGN PATENT DOCUMENTS

KR 10-1926502 B1 12/2018

*Primary Examiner* — Renee S Luebke
*Assistant Examiner* — Paul D Baillargeon
(74) *Attorney, Agent, or Firm* — Barley Snyder

(57) ABSTRACT

An electrical connector includes an electrical connector housing having a body with a receiving portion, a movable pin, a part of the movable pin is movably disposed in the receiving portion, a first elastic piece disposed in the receiving portion, and a second elastic piece located between a side wall of the receiving portion and the movable pin and elastically abutted against an outer circumferential surface of the movable pin. A first end of the movable pin movably protrudes out of the receiving portion against an elasticity of the first elastic piece. The movable pin is electrically connected to the electrical connector housing by the first elastic piece and the second elastic piece.

16 Claims, 13 Drawing Sheets

(56) References Cited

U.S. PATENT DOCUMENTS

| | | | | |
|---|---|---|---|---|
| 8,062,078 | B2 * | 11/2011 | Asai | H01R 13/2421 439/823 |
| 9,748,680 | B1 * | 8/2017 | Huang | H01R 12/714 |
| 10,535,942 | B2 * | 1/2020 | Sugiura | H01R 13/17 |
| 10,622,765 | B2 * | 4/2020 | Song | H01R 13/17 |
| 2004/0077219 | A1 * | 4/2004 | Wen-Yao | H01R 13/2421 439/638 |
| 2006/0172561 | A1 * | 8/2006 | Clark | H01R 13/6315 439/63 |
| 2019/0305484 | A1 | 10/2019 | Song et al. | |

* cited by examiner

ELECTRICAL CONNECTOR HOUSING, ELECTRICAL CONNECTOR AND ELECTRICAL CONNECTOR ASSEMBLY

CROSS-REFERENCE TO RELATED APPLICATION

This application claims the benefit of the filing date under 35 U.S.C. § 119(a)-(d) of Chinese Patent Application No. 201811578115.3, filed on Dec. 21, 2018.

FIELD OF THE INVENTION

The present invention relates to an electrical connector housing and, more particularly, to an electrical connector housing capable of maintaining stable contact with a movable pin.

BACKGROUND

Some existing electrical connectors generally comprise a movable pin which is placed in a receiving portion of a cylindrical electrical connector housing. A first end of the movable pin is located in the receiving portion and protrudes out of the receiving portion against elasticity of a spring, so as to be electrically connected to a connection terminal. The movable pin is generally kept in contact with the electrical connector housing by a slope at an end of the pin. However, such contact is not stable enough, particularly when there is a vibration or external force applied to the movable pin. This results in poor contact between the movable pin and the electrical connector housing, thereby generating high frequency resonance and current transient interruption.

SUMMARY

An electrical connector includes an electrical connector housing having a body with a receiving portion, a movable pin, a part of the movable pin is movably disposed in the receiving portion, a first elastic piece disposed in the receiving portion, and a second elastic piece located between a side wall of the receiving portion and the movable pin and elastically abutted against an outer circumferential surface of the movable pin. A first end of the movable pin movably protrudes out of the receiving portion against an elasticity of the first elastic piece. The movable pin is electrically connected to the electrical connector housing by the first elastic piece and the second elastic piece.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
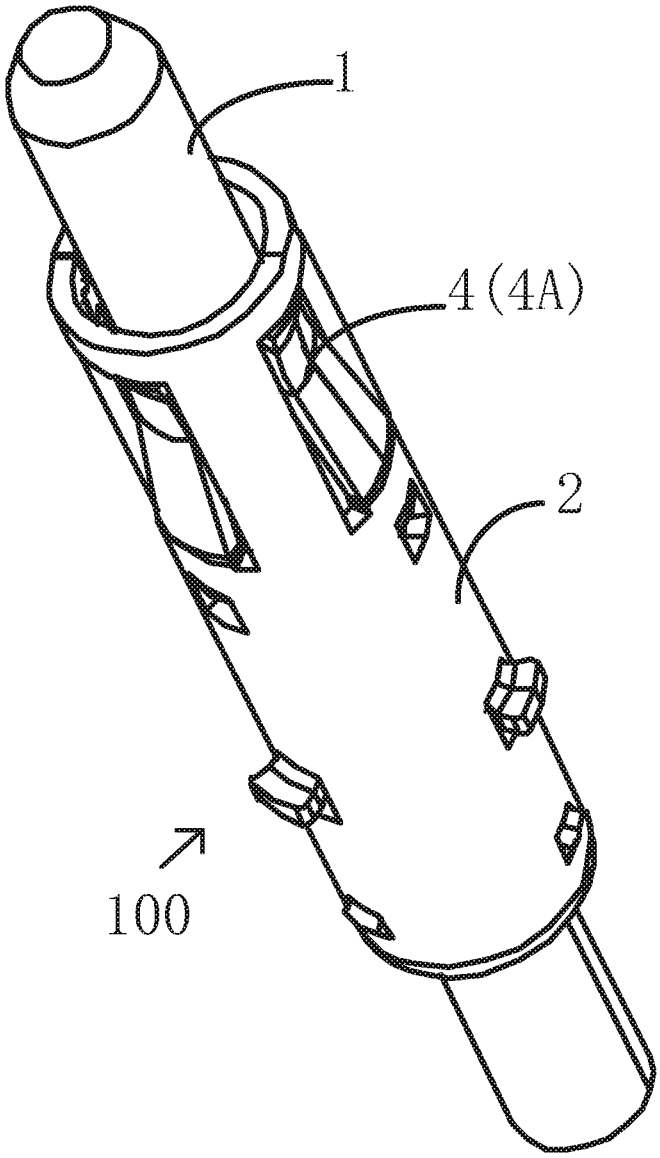
FIG. 1 is a perspective view of an electrical connector according to an embodiment.

Exemplary embodiments of the present disclosure will be described hereinafter in detail with reference to the attached drawings, wherein like reference numerals refer to like elements. It should be understood that the description of the embodiments of the present disclosure in conjunction with the attached drawings is to convey a general concept of the present disclosure to the person of ordinary skill in the art; the present disclosure is not limited to the described exemplary embodiments.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

An electrical connector 100, as shown in FIGS. 1-5, comprises a cylindrical electrical connector housing 2 having a body 21, a movable pin 1, a first elastic piece 3 and a plurality of second elastic pieces 4. A cylindrical receiving portion 22 is formed in the body 21, a part of the movable pin 1 is movably located in the receiving portion 22, and the first elastic piece 3 is located in the receiving portion 22. A first end 11 of the movable pin 1 movably protrudes out of the receiving portion 22 against elasticity of the first elastic piece 3. The plurality of second elastic pieces 4 are located between a side wall of the receiving portion 22 and the movable pin 1 and are configured to be elastically abutted against an outer circumferential surface of the movable pin 1, so that the movable pin 1 may be electrically connected to the electrical connector housing 2 by the first elastic piece 3 and the second elastic pieces 4. In this embodiment, the plurality of second elastic pieces 4 are a plurality of elastic arms 4A integrally connected to the body 21 and are distributed at intervals in a circumferential direction of the receiving portion 22, so that the movable pin 1 may be kept in electrical contact with the electrical connector housing 2 by the first elastic piece 3 and the second elastic pieces 4 in the event of vibration or external force applied to the movable pin 1. In an embodiment, the electrical connector housing 2 is formed as a single conductive member by stamping a single sheet of metal.

Figure 2:
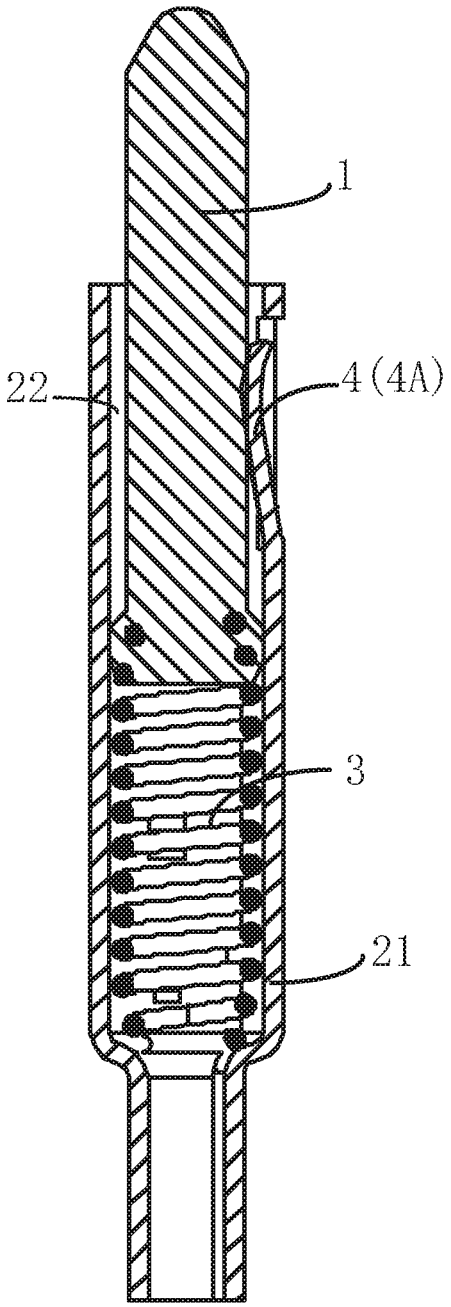
FIG. 2 is a sectional side view of the electrical connector.
Figure 3:
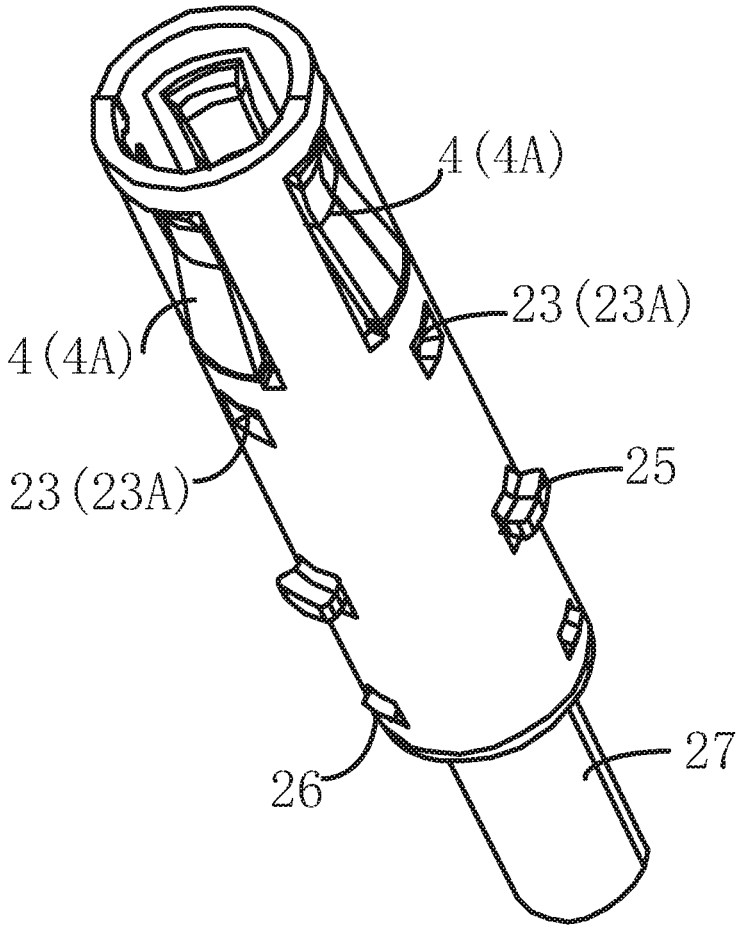
FIG. 3 is a perspective view of an electrical connector housing according to an embodiment.

Each of the elastic arms 4A, as shown in FIGS. 1-3, is formed as an arc-shaped structure protruding from the inner side surface of the electrical connector housing 2 toward the movable pin 1 to be in elastic contact with the movable pin 1, thereby making the movable pin 1 be in reliable electrical contact with the electrical connector housing 2.

Figure 4:
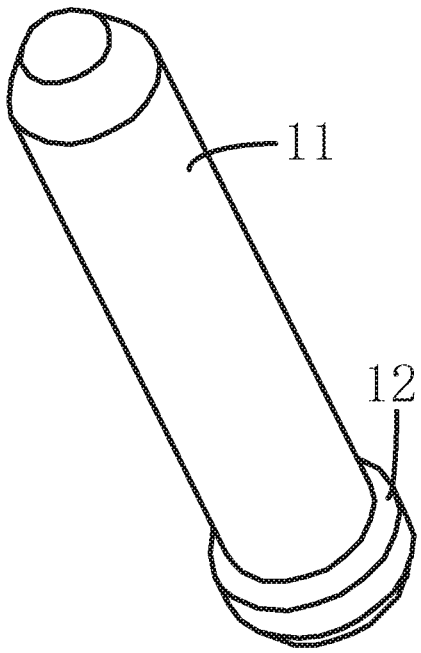
FIG. 4 is a perspective view of a movable pin according to an embodiment.
Figure 5:
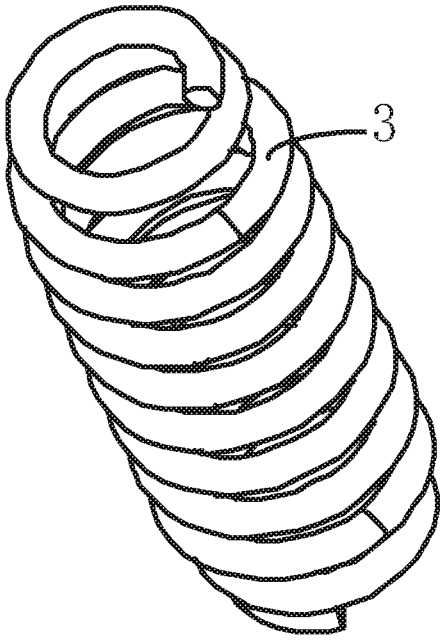
FIG. 5 is a perspective view of a first elastic piece according to an embodiment.

As shown in FIGS. 2-4, the first end 11 of one movable pin 1 protrudes out of a first end of the receiving portion 22 to be electrically connected to a first electronic component, such as a PCB, and the first elastic piece 3 is located between a second end 12 of the movable pin 1 opposite to the first end 11 and a second end of the receiving portion 22. The second end of the receiving portion 22 is closed and has an extension portion 27 extending away from the first end of the receiving portion 22 to be electrically connected to a second electronic component, such as another PCB.

As shown in FIGS. 1-3, each of the elastic arms 4A extends in an axial direction of the body 21, thereby facilitating insertion of the movable pin 1 into the receiving portion 22 of the electrical connector housing 2. In other embodiments, the elastic arm 4A may also extend in a circumferential direction of the body 21, for example. The plurality of elastic arms 4A are distributed at regular intervals in the circumferential direction of the body 21, thereby making it easy for the movable pin 1 to be positioned at the center of the receiving portion 22 by the elastic force of the plurality of elastic arms 4A. That is, the axis of the movable pin 1 coincides with the axis of the receiving portion 22.

As shown in FIGS. 2 and 4, the movable pin 1 is rod-shaped, the first end 11 of the movable pin 1 protruding out of the receiving portion 22 of the electrical connector housing 2, the second end 12 of the movable pin 1 opposite to the first end 11 being inserted into the receiving portion 22 of the electrical connector housing 2, and an outer diameter of the first end 11 being smaller than that of the second end 12. A step is provided between the first end 11 and the second end 12 of the movable pin 1 so that the movable pin 1 is held in the electrical connector housing 2 by the step.

As shown in FIG. 3, the electrical connector housing 2 has a stopping portion 23 engaged with the second end 12 of the movable pin 1 to prevent the movable pin 1 from sliding out of the receiving portion 22. As shown in FIGS. 1-3 and 7, the stopping portion 23 has a stopping elastic sheet 23A integrally connected to the body 21 and radially protruding inward. A plurality of stopping elastic pieces 23A are distributed at regular intervals in the circumferential direction of the receiving portion 22, and the stopping elastic sheets 23A extend in the axial direction of the body 21. A connection between the stopping elastic sheet 23A and the body 21 is proximal to the first end of the receiving portion 22, and an end of the stopping elastic sheet 23A opposite to the connection with the body 21 is distal to the first end of the receiving portion 22, so that the stopping elastic sheet 23A is deformed by a force of the movable pin 1 to pass the movable pin 1 during the process of inserting the movable pin 1 into the receiving portion 22. When the movable pin 1 reaches the preset position, the stopping elastic sheet 23A is restored by its elastic force, and engages the step between the first end 11 and the second end 12 of the movable pin 1, thereby preventing the movable pin 1 from slipping out of the receiving portion 22.

Figure 6:
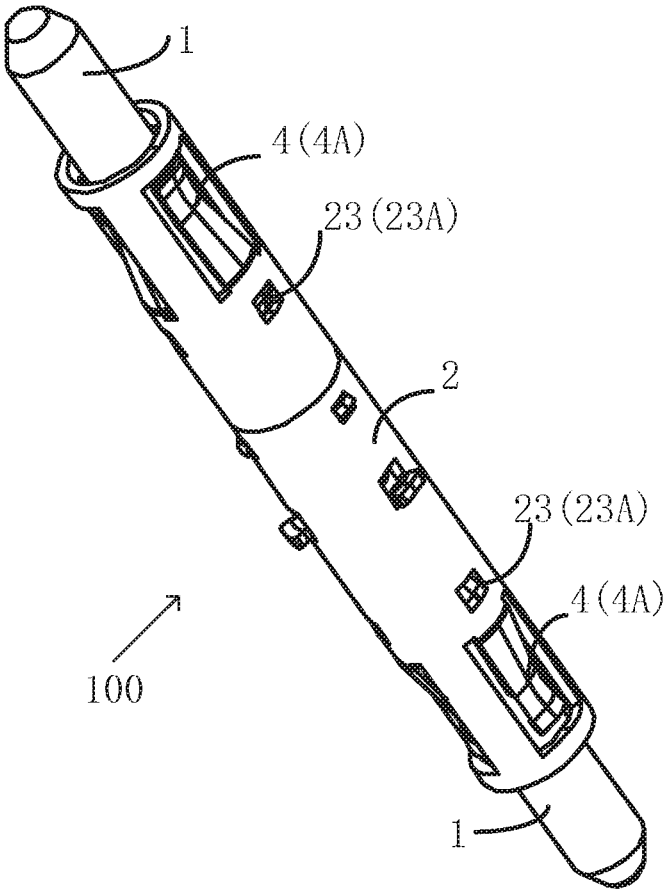
FIG. 6 is a perspective view of an electrical connector according to another embodiment.
Figure 7:
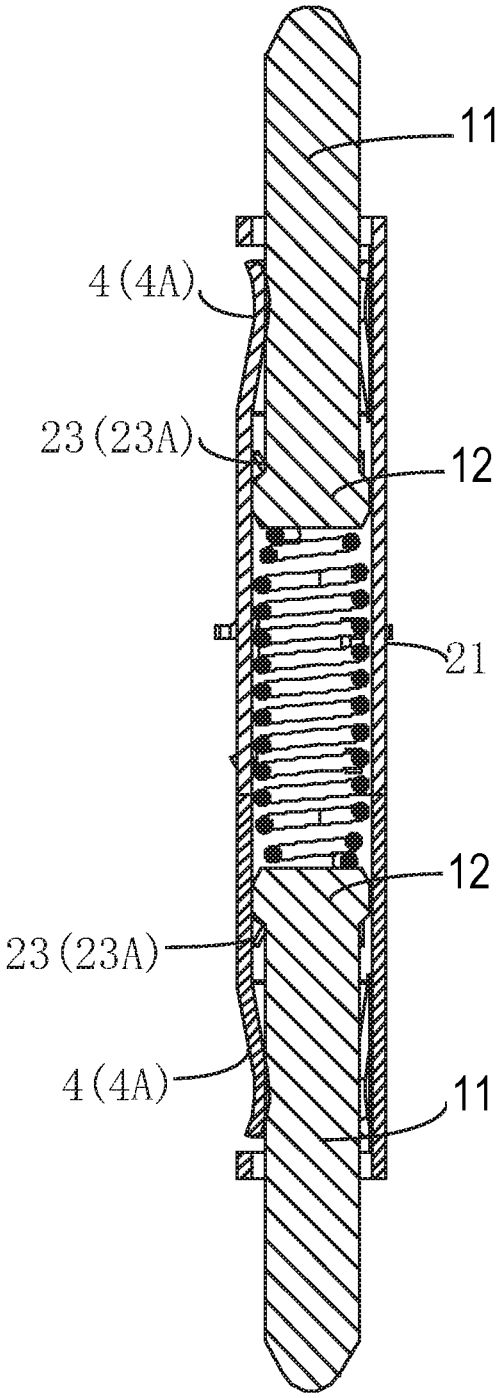
FIG. 7 is a sectional side view of the electrical connector of FIG. 6.

In an embodiment shown in FIGS. 6 and 7, the electrical connector 100 comprises two movable pins 1, first ends 11 of the two movable pins 1 protruding out of the opposite first and second ends of the receiving portion 22 to be respectively electrically connected to the first electronic component and the second electronic component. The first elastic piece 3 is located between the two movable pins 1. Opposite ends of the first elastic piece 3 are elastically abutted against the two movable pins 1.

The electrical connector housing 2 of the electrical connector 100, as shown in FIGS. 9-12, comprises a body 21, a movable pin 1, a first elastic piece 3, and a second elastic piece 4. A cylindrical receiving portion 22 is formed in the body 21, and a part of the movable pin 1 is movably located in the receiving portion 22. The first elastic piece 3 is located in the receiving portion 22, the first end of the movable pin 1 movably protrudes out of the receiving portion 22 against elasticity of the first elastic piece 3. The second elastic piece 4 has a tube spring 4B provided between the side wall of the electrical connector housing 2 and the movable pin 1 and configured to be elastically abutted against the outer circumferential surface of the movable pin 1 and the side wall of the electrical connector housing 2, so that the movable pin 1 may be electrically connected to the electrical connector housing 2 by the first elastic piece 3 and the second elastic piece 4. The electrical connector housing 2 is formed as a single conductive member by stamping a single sheet of metal.

Figure 10:
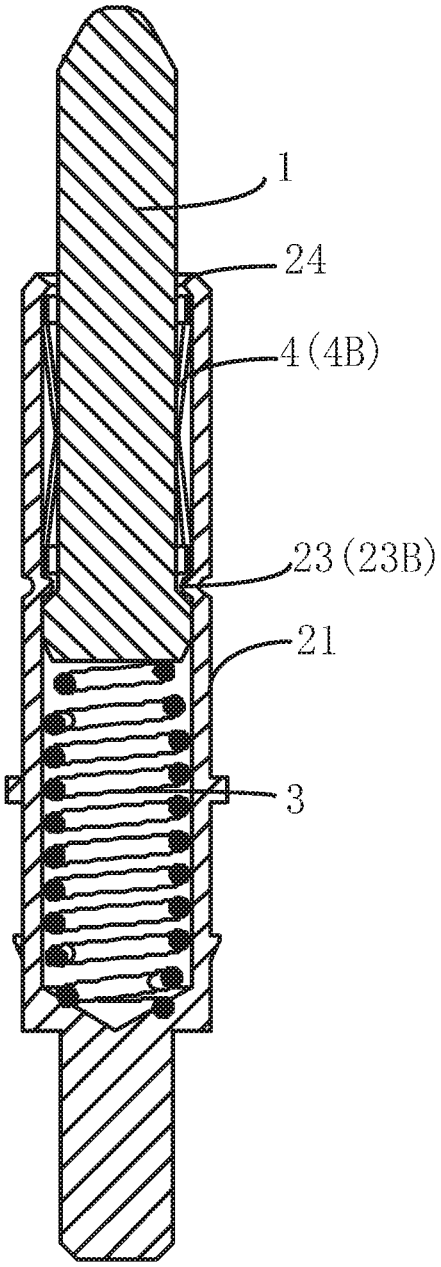
FIG. 10 is a sectional side view of the electrical connector of FIG. 9.
Figure 12:
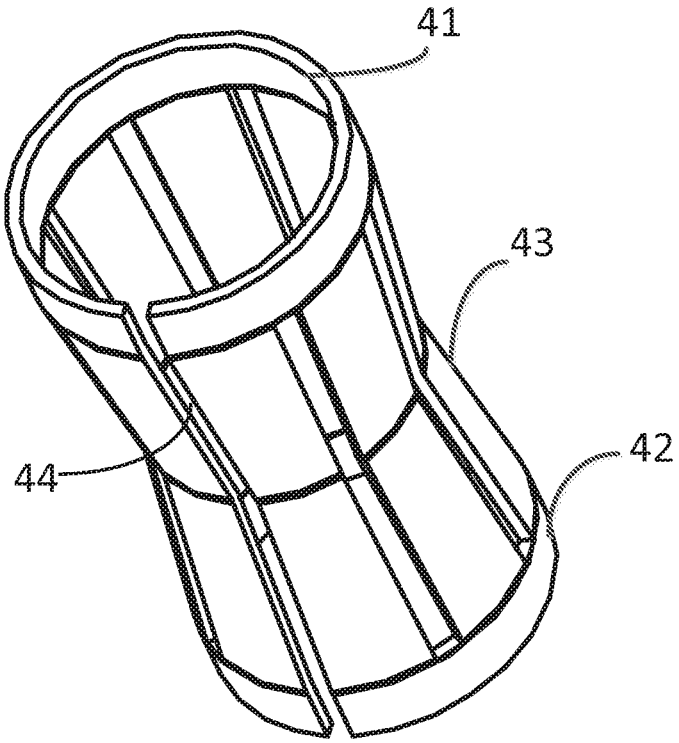
FIG. 12 is a perspective view of a tube spring according to an embodiment.

As shown in FIGS. 10 and 12, the tube spring 4B has a plurality of elastic sheets 43 distributed at regular intervals in a circumferential direction of the tube spring 4B, each of the elastic sheets 43 axially extending from two opposite ends 41, 42 of the tube spring toward each other and being formed as a V-shaped structure protruding toward the movable pin 1 so as to be elastically abutted against the outer circumferential surface of the movable pin 1. The two opposite ends 41, 42 of the tube spring 4B are in electrical contact with the side wall of the electrical connector housing 2, so that the movable pin 1 is electrically connected to the electrical connector housing 2 by the second elastic piece 4. In other embodiments, the elastic piece 43 may have an arc structure protruding toward the movable pin 1, for example. In other embodiments, the tube spring 4B may only have a single elastic piece 43.

As shown in FIG. 12, the tube spring 4B has an open slot 44 extending axially through the ends 41, 42 of the tube spring. The range of deformation of the tube spring 4B may be made larger to be applicable to the receiving portions 22 of different sizes (i.e., inner diameters) as much as possible by the open groove 44.

As shown in FIG. 10, the stopping portion 23 has a recess 23B formed in the body 21 and extending in the circumferential direction of the body 21, and the recess 23B may interfere with the step between the first end 11 and the second end 12 of the movable pin 1, preventing the movable pin 1 from slipping out of the receiving portion 22. The first end of the receiving portion 22 has a flange 24 protruding radially inward to prevent impurities such as dust from entering the receiving portion 22, and to prevent the tube spring 4B from slipping out of the receiving portion 22.

Figure 8:
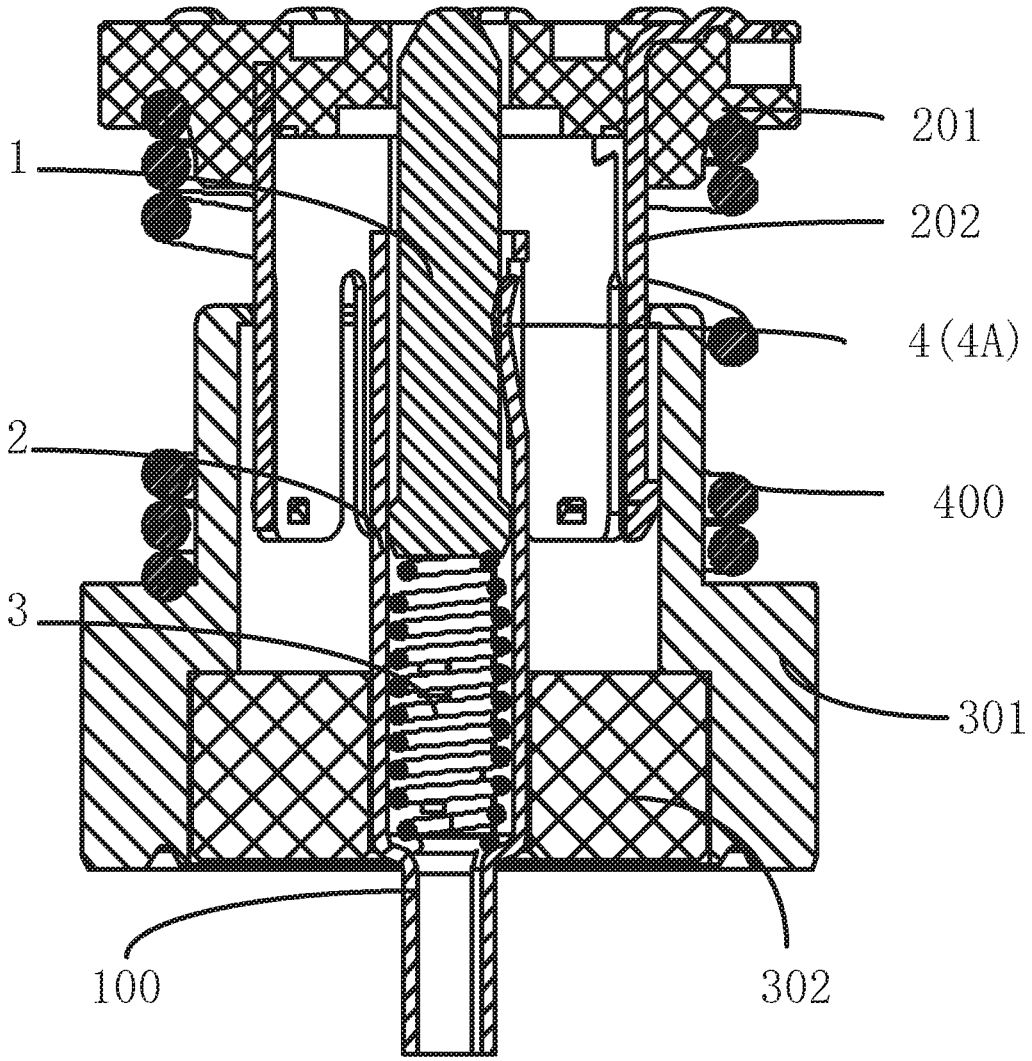
FIG. 8 is a sectional side view of an electrical connector assembly according to an embodiment.
Figure 9:
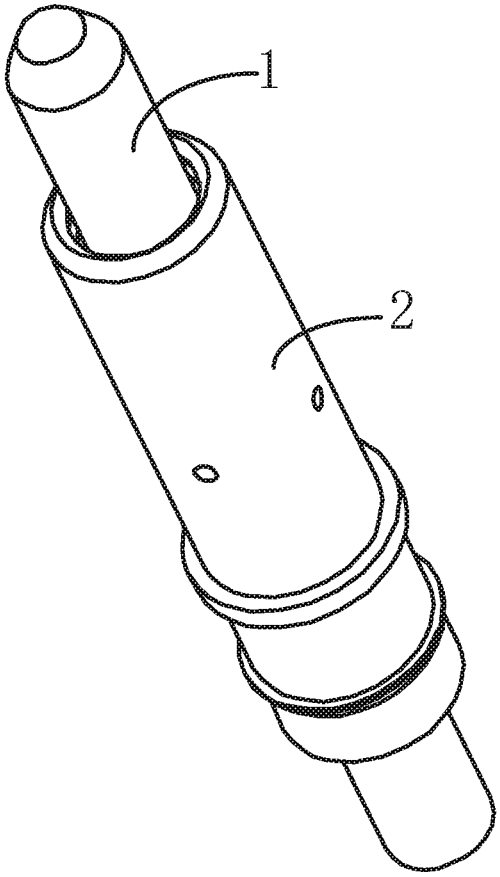
FIG. 9 is a perspective view of an electrical connector according to another embodiment.
Figure 13:
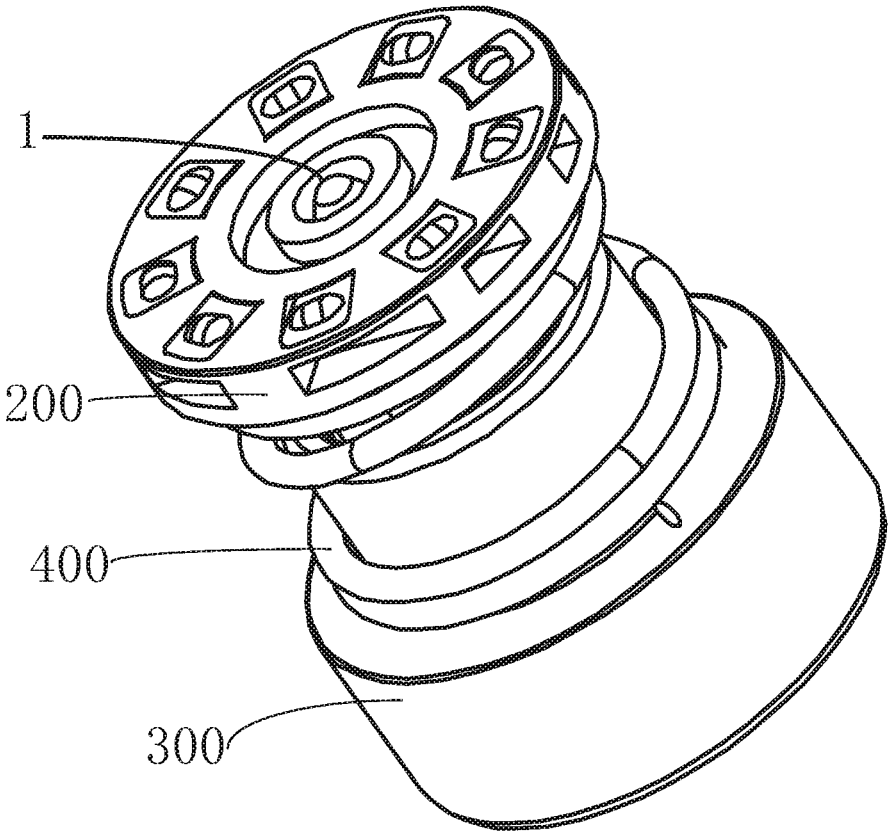
FIG. 13 is a perspective view of an electrical connector assembly according to an embodiment.

An electrical connector assembly according to an embodiment, as shown in FIGS. 8 and 13, comprises the electrical connector 100 and a cylinder 300 having an outer conductive cylinder 301 and an inner insulation cylinder 302. The inner insulation cylinder 302 is disposed within the outer conductive cylinder 301, and the electrical connector 100 is mounted within the inner insulation cylinder 302 and is isolated from the outer conductive cylinder 301 by the inner insulation cylinder 302.

Figure 11:
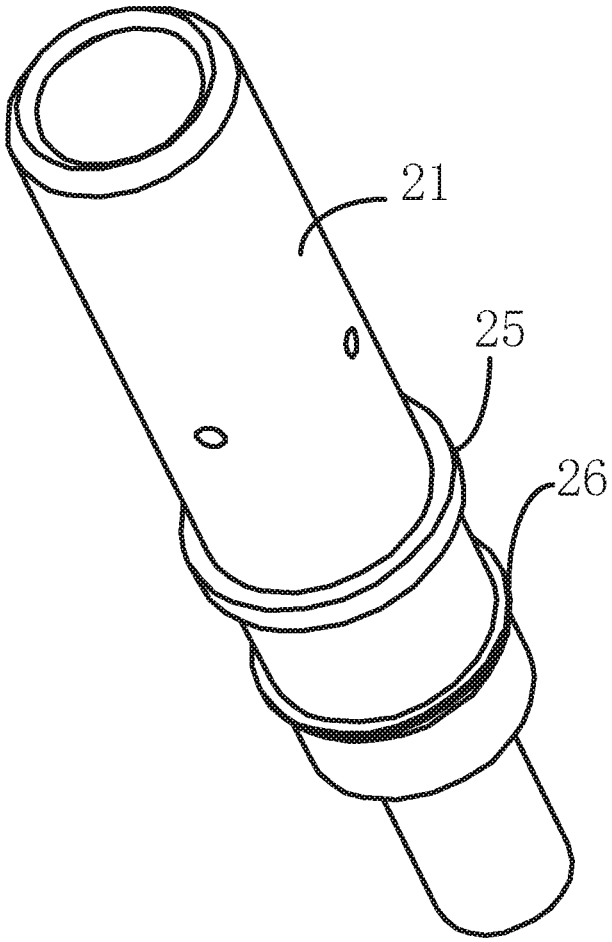
FIG. 11 is a perspective view of a body of an electrical connector housing according to an embodiment.

As shown in FIGS. 3, 8, and 11, the electrical connector housing 2 has a positioning tab engaged with the inner insulation cylinder 302, the positioning tab including an upper positioning tab 25 engaged with an upper surface of the inner insulation cylinder 302 and a lower positioning tab 26 engaged with a lower surface of the inner insulation cylinder 302. The electrical connector housing 2 and the inner insulation cylinder 302 are assembled together by the upper and lower positioning tabs 25, 26.

Figure 14:
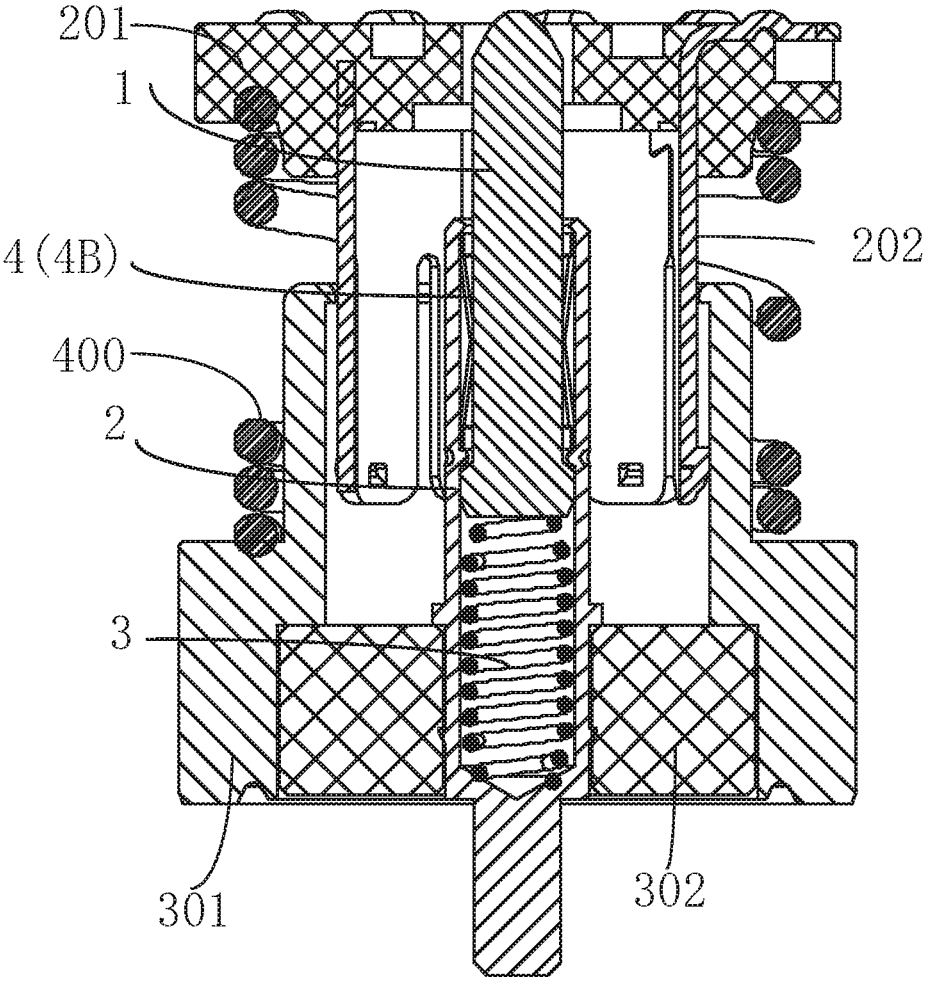
FIG. 14 is a sectional side view of the electrical connector assembly of FIG. 13.

The electrical connector assembly, as shown in FIGS. 8, 13, and 14, comprises a mating connector 200 including an insulation base 201 and a connection terminal 202 connected to the insulation base 201. The connection terminal 202 extends partially into the outer conductive cylinder 301 and is electrically connected to the outer conductive cylinder 301. The electrical connector assembly further comprises a third elastic piece 400, such as a spring, two ends of the third elastic piece 400 being elastically abutted against the insulation base 201 and the outer conductive cylinder 301, such that pressure provided by the third elastic piece 400 ensures that the first electronic component at an upper end is stably and electrically connected with the second electronic component at a lower end of the electrical connector assembly.

In the electrical connector 100, the electrical connector housing 2, and the electrical connector assembly, the second elastic piece 4 is provided between the side wall of the receiving portion 22 and the movable pin 1, and is elastically abutted against the outer circumferential surface of the movable pin 1, so that the movable pin 1 is electrically connected to the electrical connector housing 2 by the first elastic piece 3 and the second elastic piece 4, improving the reliability of electrical contact. The movable pin 1 may be kept in electrical contact with the electrical connector housing 2 by the first and the second elastic pieces 3, 4 even in the event of vibration or external force applied to the movable pin 1, thereby avoiding the occurrence of high frequency resonance and current transient interruption. The electrical connector assembly may comprise a radio frequency coaxial connector adapted to be electrically connected between the first electronic component and the second electronic component.

It will be understood by those skilled in the art that the above-described embodiments are exemplary and that modifications may be made by those skilled in the art, and that structures described in the various embodiments may be freely combined without conflict in structure or principle. Although the embodiments of the present disclosure have been described in detail, it will be apparent to those skilled in the art that various changes and modifications can be made without departing from the scope and spirit of the appended claims, and the disclosure is not limited to the exemplary embodiments illustrated in the specification.

What is claimed is:

1. An electrical connector, comprising:

an electrical connector housing having a body with a receiving portion;

a movable pin, a part of the movable pin is movably disposed in the receiving portion;

a first elastic piece disposed in the receiving portion, a first end of the movable pin movably protruding out of the receiving portion against an elasticity of the first elastic piece, a second end of the movable pin opposite to the first end is inserted into the receiving portion;

a second elastic piece having an elastic arm integrally connected to the body and located between a side wall of the receiving portion and the movable pin and elastically abutted against an outer circumferential surface of the movable pin, the movable pin is electrically connected to the electrical connector housing by the first elastic piece and the second elastic piece; and a stopping portion integrally connected to the body and separate from the second elastic piece, the stopping portion engaging with the second end of the movable pin to prevent the movable pin from sliding out of the receiving portion.

2. The electrical connector of claim 1, wherein the elastic arm has an arc-shaped structure protruding from an inner side surface of the electrical connector housing toward the movable pin to be in elastic contact with the movable pin.

3. The electrical connector of claim 1, wherein the elastic arm extends in an axial direction of the body.

4. The electrical connector of claim 3, wherein a free end of the elastic arm extends in a first axial direction of the body, and a free end of the stopping portion extends in a second axial direction of the body, opposite the first axial direction.

5. The electrical connector of claim 1, wherein the movable pin is rod-shaped and an outer diameter of the first end is smaller than an outer diameter of the second end.

6. The electrical connector of claim 5, wherein the second elastic piece is arranged proximal to a first open end of the receiving portion and the stopping portion is arranged distal to the first open end of the receiving portion, a connection between the stopping portion and the body being proximal to the first end of the receiving portion and an end of the stopping portion opposite to the connection to the body is distal to the first end of the receiving portion.

7. The electrical connector of claim 6, wherein the stopping portion comprises a plurality of stopping portions distributed in a circumferential direction of the receiving portion, connections between the plurality of stopping portions and the body are proximal to the first end of the receiving portion and ends of the stopping portions opposite to the connections to the body are distal to the first end of the receiving portion.

8. The electrical connector of claim 1, wherein the first end of the movable pin protrudes out of a first end of the receiving portion, and the first elastic piece is located between a second end of the movable pin opposite to the first end and a second end of the receiving portion, the second end of the receiving portion is closed and has an extension portion extending away from the first end of the receiving portion.

9. An electrical connector, comprising:

an electrical connector housing having a body with a receiving portion;

a first movable pin, a part of the first movable pin is movably disposed in the receiving portion;

a first elastic piece disposed in the receiving portion, a first end of the movable pin movably protruding out of the receiving portion against an elasticity of the first elastic piece, a second end of the movable pin opposite to the first end is inserted into the receiving portion;

a second elastic piece located between a side wall of the receiving portion and the movable pin and elastically abutted against an outer circumferential surface of the movable pin, the movable pin is electrically connected to the electrical connector housing by the first elastic piece and the second elastic piece;

a stopping portion integrally connected to the body and separate from the second elastic piece, the stopping portion engaging with the second end of the movable pin to prevent the movable pin from sliding out of the receiving portion; and a second movable pin having a first end protruding out of an opposite end of the receiving portion as the first end of the first movable pin, the first elastic piece is between the first and second movable pins.

10. An electrical connector housing, comprising:

a body having a receiving portion;

an elastic arm integrally connected to the body and elastically abutted against an outer circumferential surface of a movable pin, a part of the movable pin is movably disposed in the receiving portion, the elastic arm located between a side wall of the receiving portion and the movable pin;

an elastic piece disposed in the receiving portion, a first end of the movable pin movably protruding out of the receiving portion against an elasticity of the elastic piece, a second end of the movable pin opposite to the first end is inserted into the receiving portion, the movable pin is electrically connected to the body by the elastic arm and the elastic piece; and a stopping portion integrally connected to the body and separate from the elastic arm for preventing the movable pin from sliding out of the receiving portion.

11. The electrical connector housing of claim 10, wherein the elastic arm has an arc-shaped structure protruding from an inner side surface of the electrical connector housing toward the movable pin to be in elastic contact with the movable pin.

12. The electrical connector housing of claim 10, wherein the elastic arm extends in an axial direction of the body.

13. The electrical connector housing of claim 10, wherein opposite ends of the receiving portion are open.

14. The electrical connector housing of claim 10, wherein a first end of the receiving portion is open and a second end of the receiving portion opposite to the first end is closed, the second end of the receiving portion has an extension portion extending away from the first end of the receiving portion.

15. An electrical connector assembly, comprising:

an electrical connector including an electrical connector housing having a body with a receiving portion, a movable pin, a part of the movable pin is movably disposed in the receiving portion, a first elastic piece disposed in the receiving portion, and a second elastic piece located between a side wall of the receiving portion and the movable pin and elastically abutted against an outer circumferential surface of the movable pin, a first end of the movable pin movably protrudes out of the receiving portion against an elasticity of the first elastic piece, the movable pin is electrically connected to the electrical connector housing by the first elastic piece and the second elastic piece;

a cylinder including an outer conductive cylinder and an inner insulation cylinder provided in the outer conductive cylinder, the electrical connector is disposed in the inner insulation cylinder and isolated from the outer conducting cylinder by the inner insulation cylinder;

a mating connector including an insulation base; and a third elastic piece, a pair of opposite ends of the third elastic piece are elastically abutted against the insulation base and the outer conductive cylinder.

16. The electrical connector assembly of claim 15, wherein the mating connector includes a connection terminal connected to the insulation base, the connection terminal extending partially into the outer conductive cylinder and electrically connected to the outer conductive cylinder.

* * * * *